US005671880A

United States Patent [19]

Ronconi

[11] Patent Number: 5,671,880

[45] Date of Patent: Sep. 30, 1997

[54] COMPRESSED-AIR NAIL FIRING TOOL WITH HEAD VALVE, OPERATING WITH SINGLE AND REPEAT FIRING

[75] Inventor: Marco Ronconi, Bologna, Italy

[73] Assignee: Fasco S.p.A., Cardriano Di Granarolo Emilia, Italy

[21] Appl. No.: 610,788

[22] Filed: Mar. 11, 1996

[30] Foreign Application Priority Data

Nov. 2, 1995 [IT] Italy ..... B095A0518

[51] Int. Cl.[6] ..... B25C 1/04

[52] U.S. Cl. ..... 227/130; 227/8; 91/308

[58] Field of Search ..... 227/8, 130; 91/307, 91/308, 317, 461

[56] References Cited

U.S. PATENT DOCUMENTS

| | | | |
|---|---|---|---|
| 3,552,270 | 1/1971 | Wilfried . | |
| 3,583,496 | 6/1971 | Fehrs | 227/130 |
| 3,850,079 | 11/1974 | Fehrs | 227/130 |
| 4,509,668 | 4/1985 | Klaus et al. | 227/8 |
| 4,915,013 | 4/1990 | Moraht et al. | 227/130 |
| 5,522,532 | 6/1996 | Chen | 227/130 |

FOREIGN PATENT DOCUMENTS

| | | |
|---|---|---|
| 2 104 949 | 8/1971 | Germany . |
| 9 216 386 | 2/1993 | Germany . |
| 2 157 998 | 11/1985 | United Kingdom . |

*Primary Examiner*—Scott A. Smith
*Attorney, Agent, or Firm*—Guido Modiano; Albert Josif

[57] ABSTRACT

The compressed-air nail firing tool with head valve operates with single firing or repeat firing through valves comprising a selector, a distributor, and a shunt valve that can be operated through a trigger. The selector has two positions that can be selected from the outside by the user actuating a lever and correspond to single-firing or repeat-firing operation.

5 Claims, 7 Drawing Sheets

COMPRESSED-AIR NAIL FIRING TOOL WITH HEAD VALVE, OPERATING WITH SINGLE AND REPEAT FIRING

BACKGROUND OF THE INVENTION

The present invention relates to a compressed-air nail firing tool with head valve operating with single and repeating firing.

Conventional compressed-air nail firing tools comprise a hollow head wherefrom a tubular handle extends, said handle being connected to the compressed air source.

A cylindrical jacket is located inside the hollow head, and a piston slides therein, said piston being provided with a striking blade that is guided in a channel into which the fixing elements (staples and nails) contained in a magazine are conveyed individually.

During operation, the compressed air collects above the piston by means of a so-called head valve that is controlled by a trigger-operated servovalve; by acting on said piston, the air causes, by means of the striking blade, the expulsion of a fixing element from the channel and the return of the piston to the initial position. Conventional head-valve nail firing tools operate by single firing, i.e., it is necessary to actuate the trigger control each time.

SUMMARY OF THE INVENTION

A principal aim of the present invention is to provide a nail firing tool of the described type so that it can be switched, at user's choice, from single firing to automatic repeat firing and remain in that operating mode as long as action on the trigger control continues.

Within the scope of this aim, an object of the present invention is to provide a nail firing tool of the described type in which the repeat-firing means are constructively simple in comparison with those of similar machines.

This aim and this object are achieved with a compressed-air nail firing tool with head valve operating with single and repeat firing, the characteristics whereof are defined in the appended claims.

BRIEF DESCRIPTION OF THE DRAWINGS

Further characteristics and advantages of the present invention will become apparent from the following detailed description of an embodiment thereof, illustrated only by way of non-limitative example in the accompanying drawings, wherein.

DESCRIPTION OF THE PREFERRED EMBODIMENTS

Figure 1:
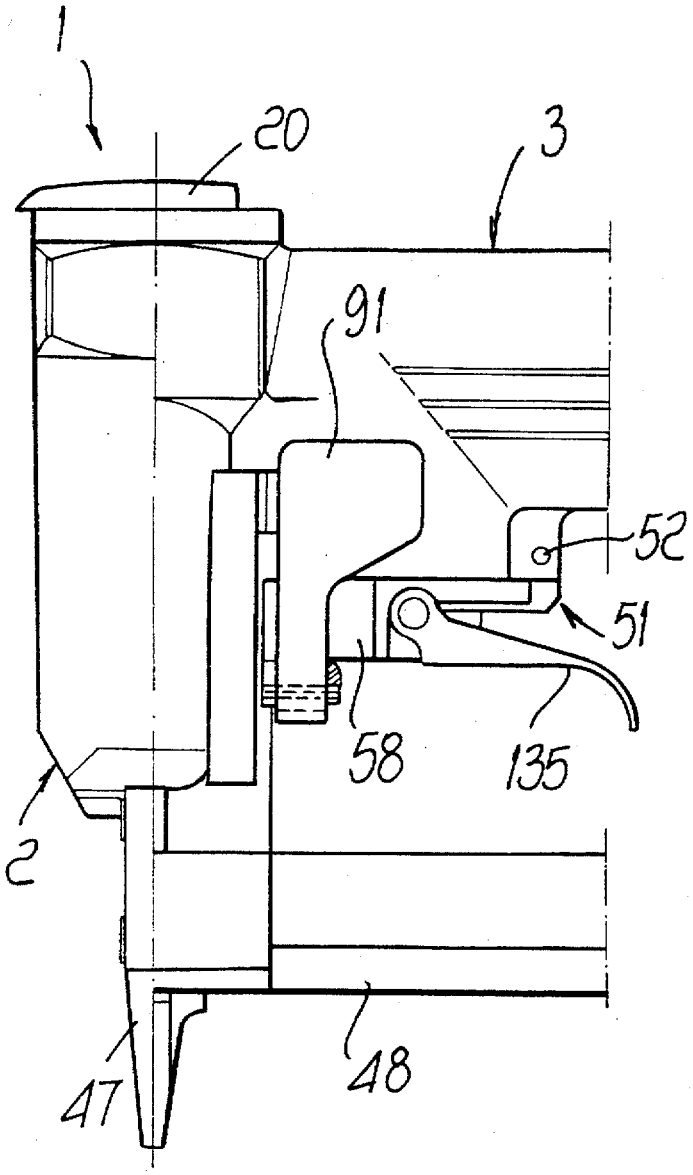
FIGS. 1 and 2 are a front view and a partial side view of the nail firing tool.

In the following description, the reference numerals used to designate the individual components of the tool are distributed between FIGS. 3 and 4 for clarity reasons. Moreover, the terms "upper" and "lower" relate to the viewing orientation of the figures.

With reference to said figures, the nail firing tool comprises a body, generally designated by the reference numeral 1, which is composed of a head 2 and of a handle 3 that protrudes from the head 2.

The handle 3 is tubular and is provided with connectors, not shown in the drawing, for its connection to a compressed air source.

The head 2 encloses a cavity 4 that is closed at the top by a cover 5 centered therein and fixed by screws with the interposition of a sealing gasket 6.

The cover 5 has a cylindrical seat 7 in which a disk 9 is guided hermetically by means of a toroidal gasket 8; said disk has a differential action and constitutes the head valve of the nail firing tool.

The valve 9 closes a chamber 10 which, by means of a duct 11 formed in the cover 5 and in the wall 12 of the head 2, is connected to the compressed air source or to the outside by valve-based actuation means, generally designated by the reference numeral 13.

The disk 9 has a tubular portion 14 which, by means of the interposition of a toroidal gasket 15, slides hermetically in a hole 16 formed in the cover 5.

A shoulder 17 is formed in the tubular portion 14 and surrounds an opening 18 passing through the disk 9. A cylindrical spring 19 rests on the shoulder 17 with one end and protrudes from the tubular portion 14 to rest on a baffle 20 fixed above the cover 5.

An elastic washer 21 is arranged around the end of the spring 19 that is in contact with the baffle 20 and is recessed in a hollow of the cover 5.

The baffle 20 closes a channel 22 formed in the upper face of the cover 5 and connected to the hole 16 through a recess 23 passing below the washer 21.

Two concentric elastic rings 24 and 25 are arranged in the face of the disk 9 that lies opposite to the tubular portion 14. The outer ring 25 is adapted to form a seal against the upper edge of a cylindrical jacket 26 that is arranged in the cavity 4 coaxially to the axis A of the disk 9, so as to delimit, together with the wall of the cavity 4, an annular interspace 27.

Positioning of the jacket is achieved by inserting one of its lower ends into a seat 28 formed in the base 29 of the head 2 and its upper end into a bush 30 that is centered in a cylindrical region 31 of the wall of the cavity 4.

Axial retention of the jacket 26 is ensured by three lips 32 of the cover 5, which act on a collar 33 lying outside the top of the jacket and acting as a locator for the bush 30.

The bush 30 divides the interspace 27 from a compartment 34 that surrounds the bush 30 and is connected to the cavity 35 lying inside the handle 3 and, therefore, to the compressed air source. The interspace 27 and the compartment 34 are hermetically separated from one another by toroidal gaskets 36 and 37 accommodated in grooves of the bush 30 and resting hermetically on the jacket 26 below the collar 33 and on the region 31.

The annular interspace 27 is constantly connected to the inside of the jacket 26 by means of a plurality of slots 38 formed proximate to the lower end. A connection is furthermore provided from the inside of the jacket 26 towards the annular interspace 27 through a plurality of perforations 39 arranged on a plane that is perpendicular to the axis A approximately halfway along the height of the jacket. A groove 40 having a semicircular cross-section is formed on the outside of the jacket 26, at the perforations 39, and a toroidal ring 41 made of rubber-like material is recessed therein. The ring 41 closes the perforations 39 from the outside, so as to act as a check valve allowing the passage of a fluid only from the inside of the jacket 26 towards the interspace 27.

A piston 44 is sealingly slideable, by means of toroidal gaskets 42 and 43, inside the jacket 26 and divides the inside of the jacket into an upper chamber 45 and a lower chamber 46. A block 44*a* is associated with the piston in a downward region and forms, together with the base of the piston, a groove 44*b* wherefrom peripheral passages 44*c* extend into the lower face of the block.

The distance of the groove 44*b* from the lower face of the block is such that when the piston 44 is at the lower stroke limit the groove 44*b* faces the slots 38.

A striking blade 46*a* is rigidly coupled to the piston 44, lies along the axis A, and protrudes from the head 2 through an opening 45*a* of the base 29.

The blade 46*a* is guided in a channel of a tip 47 that is fixed to the base 29 and is associated with a magazine 48 for containing the fixing elements (nails, staples, etcetera). The tip 47 and the magazine 48 are not described in detail since they have a conventional structure.

As will become apparent hereinafter, the piston 44, due to the compressed air, performs a downward stroke to expel, by means of the striking blade 46*a*, the fixing elements transferred from the magazine 48 into the firing channel of the tip 47, and an upward stroke to return to the initial position. To cushion the impacts of the piston at the end of the rising and descending stroke, an elastic ring 24 and a disk 49 are provided, said disk being made of elastic material and being accommodated in a recess 50 of the base 29; when the block 44*a* rests thereon, said disk closes the peripheral passages 44*c*.

Actuation of the piston 44 is controlled through said valve-based actuation means 13.

Said means comprises a plate 51 that is articulated below the handle 3 by means of a pin 52 which is driven through a lug 53 that protrudes downwardly from the handle 3.

The plate 51 is kept against a flattened region 54 lying under the handle 3 by an L-shaped element 55 that engages a step 56 of the head 2 and is fixed by a screw 57.

The plate 51 comprises a prismatic block 58 provided with a triangular protrusion 59. A cylindrical seat or recess 60 is formed in said block 58, has an axis B that is parallel to axis A, and is connected to the outside by means of slots 61; a sleeve 62 is centered in said recess and has two flanges 63 and 64. The flanges 63 and 64, by means of toroidal sealing rings 65 and 66, are inserted in a cylindrical seat 67 formed in the handle coaxially to the axis B.

The recess 60 is connected to a duct 68 that enters a seat 69 lying in the block 58 along an axis C that lies at right angles to the axis B.

The seat 69 comprises a threaded portion 70 in which a screw 72 is screwed with a threaded part 71; said screw 72 has a smooth part 73 that is guided, with the interposition of a sealing ring 74, in a smooth portion 75 of the seat 69. The screw 72, at the end lying outside the block 58, is provided with a knob 76 and, at the inner end, with a conical point 77 that engages in the hole 78 of a washer 79 located in a recess of the seat 69 against an internal annular shoulder 80.

The duct 68 leads into the chamber formed between the washer 79 and the threaded portion 71 of the screw 72.

An additional washer 81 is arranged on the side of the shoulder 80 that lies opposite to the washer 79, and surrounds a hole 82 connected to the hole 78 by means of the collar 80.

The washer 81 is located in a cylindrical portion 83 of the seat 69 that widens into a portion 84 having a larger diameter ending with a collar 85.

A shutter 86, constituted by a pin that is guided hermetically by means of toroidal gaskets 88, slides in the portions 83 and 84. The shutter 86 has, at one end, a conical point 87 adapted to engage, in one position, in the hole 82 to close it, and has, at the opposite end, a tang that protrudes from the seat 69 and in which a diametrical hole 89 is formed. A pin 90 driven into the collar 85 is guided through the diametrical hole 89. The play of the pin 90 in the hole 89 is such that the pin 86 can slide in the portion 84 until the conical point 87 closes the hole 82.

Figure 2:
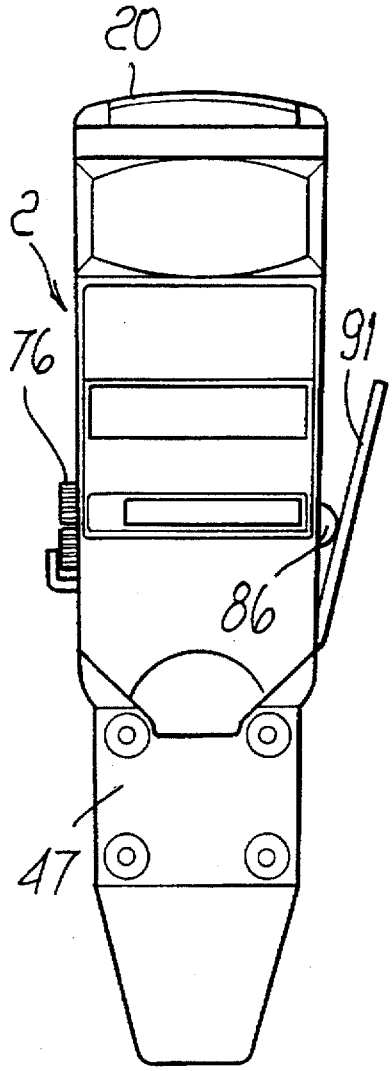

The actuation of the pin 86 is controlled by a lever 91 that is pivoted under the block 58 (see FIGS. 1 and 2) and is actuatable by the user when he wishes to pass from single-firing operation of the nail firing tool to repeat-firing operation and vice versa. The lever 21 and the pin 86 form therefore a selector for the type of operation of the nail firing tool.

A hole 92 extends from the portion 83 of the seat 69; through an additional hole 93 formed in the wall 12 of the head 2, said hole 92 connects the annular interspace 27 to the seat 69. The connection between the holes 92 and 93 is sealed by a gasket 94 that is interposed between the wall 12 and the block 58. A connection is thus established between the annular interspace 27 and the recess 60 and it can be closed when the point 86 engages the hole 82 or can be reduced by screwing or unscrewing the screw 72 to varying extents, so that the conical point 77 adjusts the passage section of the hole 78.

The duct 68 is orientated at an angle so as to lead, proximate to the bottom of the recess 60, into a chamber 95 formed by a piston 96 that is sealingly slideable, by means of a toroidal ring 96*a*, in the recess 60 and forms a distributor with a stem 97 rigidly coupled thereto. The stem 97 extends into the sleeve 62 and has three collars 98, 99, and 100, around which toroidal sealing gaskets 101, 102, and 103 are arranged.

The collar 98 is guided in a seat 104 of the sleeve 62 and the collars 99 and 100 are guided in a seat 105 of said sleeve that is formed by a tubular extension 106 which, by means of a toroidal gasket 106*a*, passes hermetically through the wall of the handle 3 to lead into the cavity 35.

The diameter of the collar 98 is greater than the diameter of the seat 104, so that an annular chamber 107 is formed around the stem portion lying between the collars 98 and 99; said annular chamber is constantly connected, through holes 108 that are adjacent to the collar 63, to an annular chamber 109 lying outside the sleeve and enclosed between the collars 63 and 64.

Figure 5:
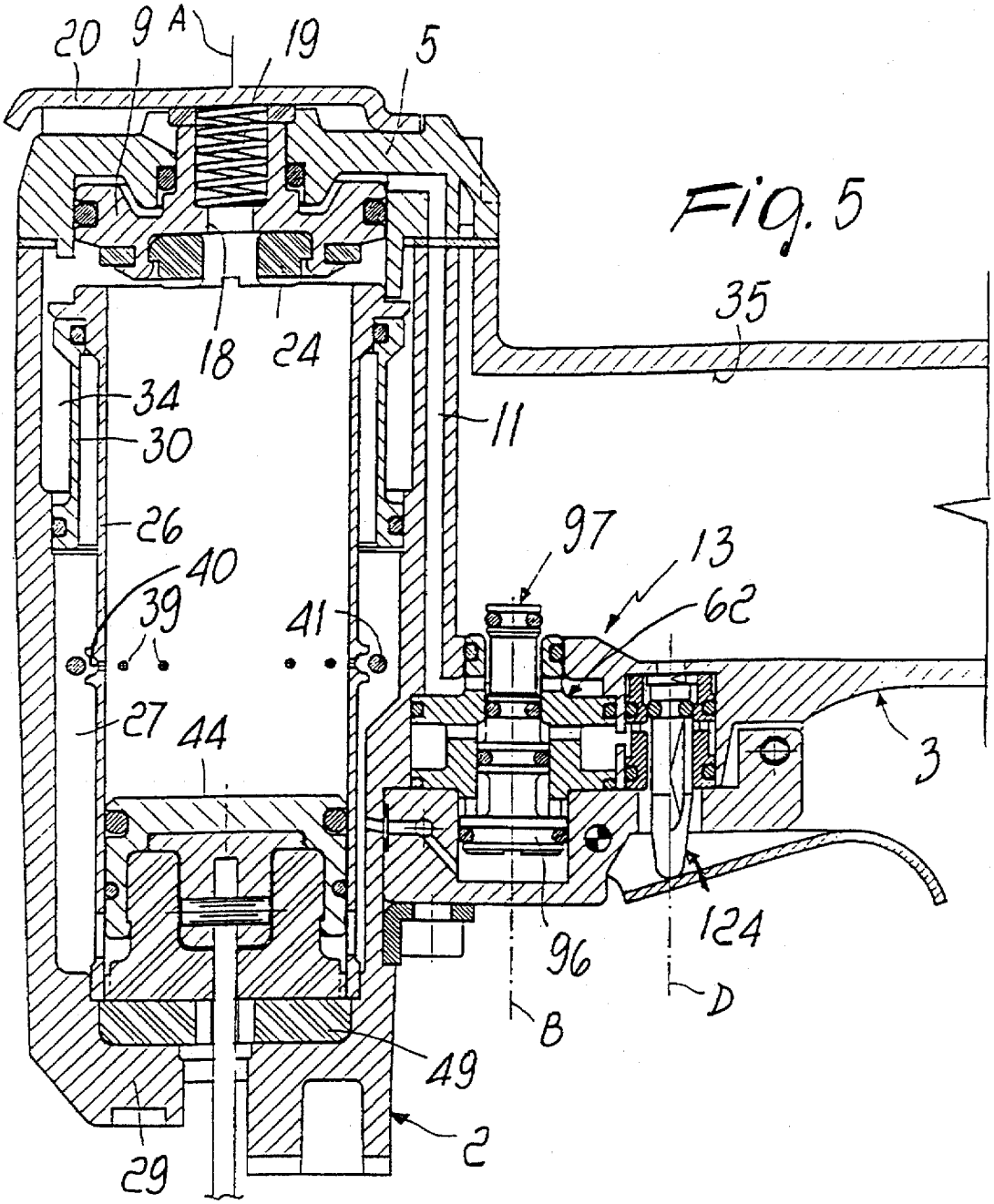

An annular chamber 110 is furthermore formed between the portion of the stem 97 that lies between the collars 99 and 100 and the seat 105; through radial holes 111, said chamber 110 is connected to an outer annular chamber 112 constantly connected to the duct 11. The distributor 96, 97 is capable of assuming two positions. In one of these positions, shown in FIG. 3, the piston 97 rests on the bottom of the recess 60 and the chambers 107 and 110 are connected to each other, whereas the collar 100 closes the seat 105 towards the cavity 35. In the other position, in which the piston 97 rests against the sleeve 62, the collar 99 interrupts the connection between the chambers 107 and 110, whereas the collar 100, by protruding from the seat 105, allows the connection of the chamber 110 to the cavity 35, as shown in FIG. 5.

A second duct 113 extends from the recess 60, in addition to the duct 68, and leads into the seat 84. When the pin 87 is in the position for closing the hole 82, the duct 113 connects the chamber 95 to the outside by means of a flattened region 114 of the pin 86.

The seat 67, by means of a slot 115, is connected to an adjacent cylindrical seat 116 the axis D whereof is parallel to the axis B and lies on the plane passing through the axes A and B.

A bush 117 is accommodated in the seat 116 and is externally provided with two annular grooves, in which two toroidal gaskets 118 and 119 are accommodated and are hermetically in contact with the cylindrical wall of the seat 116 above and below the slot 115. The portion of the bush 117 lying between the gaskets 118 and 119 has an outer region provided with a reduced diameter that forms an annular chamber 120 connected to the chamber 109 by means of the slot 115.

The annular chamber 120, by means of a plurality of radial holes 121, is connected to a groove 122 formed inside the bush 117.

A toroidal ring 123 is loosely engaged in the groove 122 and is applied to a stem 124 that slides in the bush 117.

The stem 124 extends downwardly with a part 125 that is guided in the bush 117 and protrudes outside below the handle through an opening 126 of the protrusion 59 of the plate 51 and has chamfers 127 that are distributed peripherally and run along the axis D.

Above the ring 123, the stem 124 comprises a portion 128 the diameter whereof is smaller than the inside diameter of the bush 117, so that a gap 129 remains between the opposite surfaces of the portion 128 and of the bush 117. The portion 128 is surmounted by a flange 130 adapted to abut against a shoulder 131 lying inside the bush. The flange 130 is also provided with peripheral chamfers 132 that allow to connect the gap 129 to an overlying chamber 133 and, through an opening 134, to the cavity 35 of the handle.

The stem 124 and the ring 123 form a sort of shunt valve.

In one position of the shunt valve (shown in FIG. 3), the pressure of the compressed air, by acting axially through the opening 134 on the stem 124, keeps the flange 130 rested against the shoulder 131. In this position, the ring 123 rests on the lower side of the groove 122, closing the discharge of compressed air through the bush and allowing the compressed air to pass through the holes 121 into the chamber 120.

Vice versa, in the other position of the shunt valve, when the stem 124 is raised (see FIG. 4), the ring 123 rests on the upper side of the groove 122, engaging the bush portion that lies above the holes 121 and closing the compressed air inlet, whereas the holes 121 are connected to the outside by means of the chamfers 127.

The movement of the stem 124 is actuated by a lever 135 that is articulated in a trigger-like fashion in the plate 51.

The lever 135 is formed by a metal plate folded in a U-like shape, with two parallel wings 136, between which the portion 58 of the plate 51 is inserted and through which the articulation pivot 137 is driven.

Figure 3:
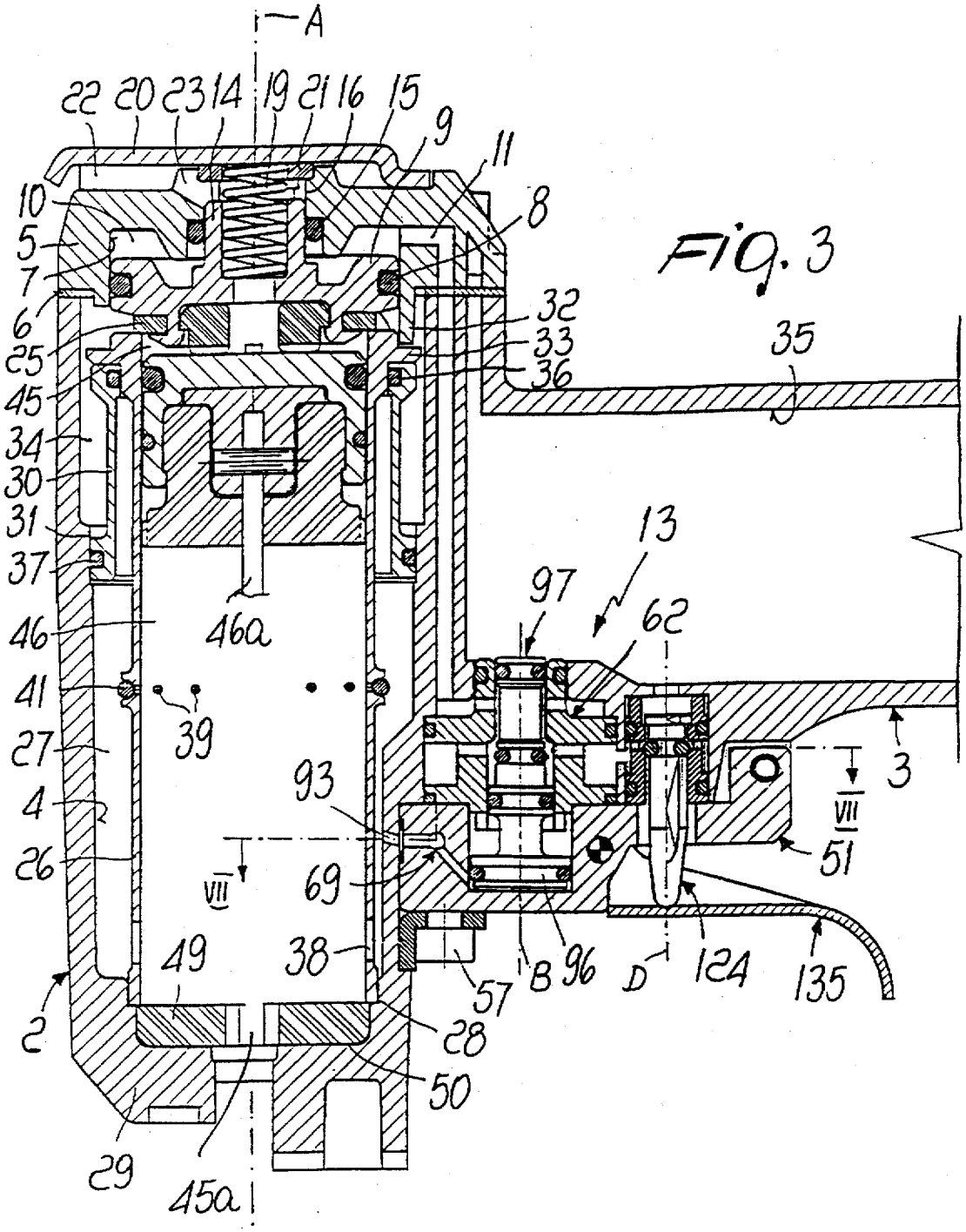
FIG. 3 is a sectional view of a nail firing tool in the operating position.
Figure 6:
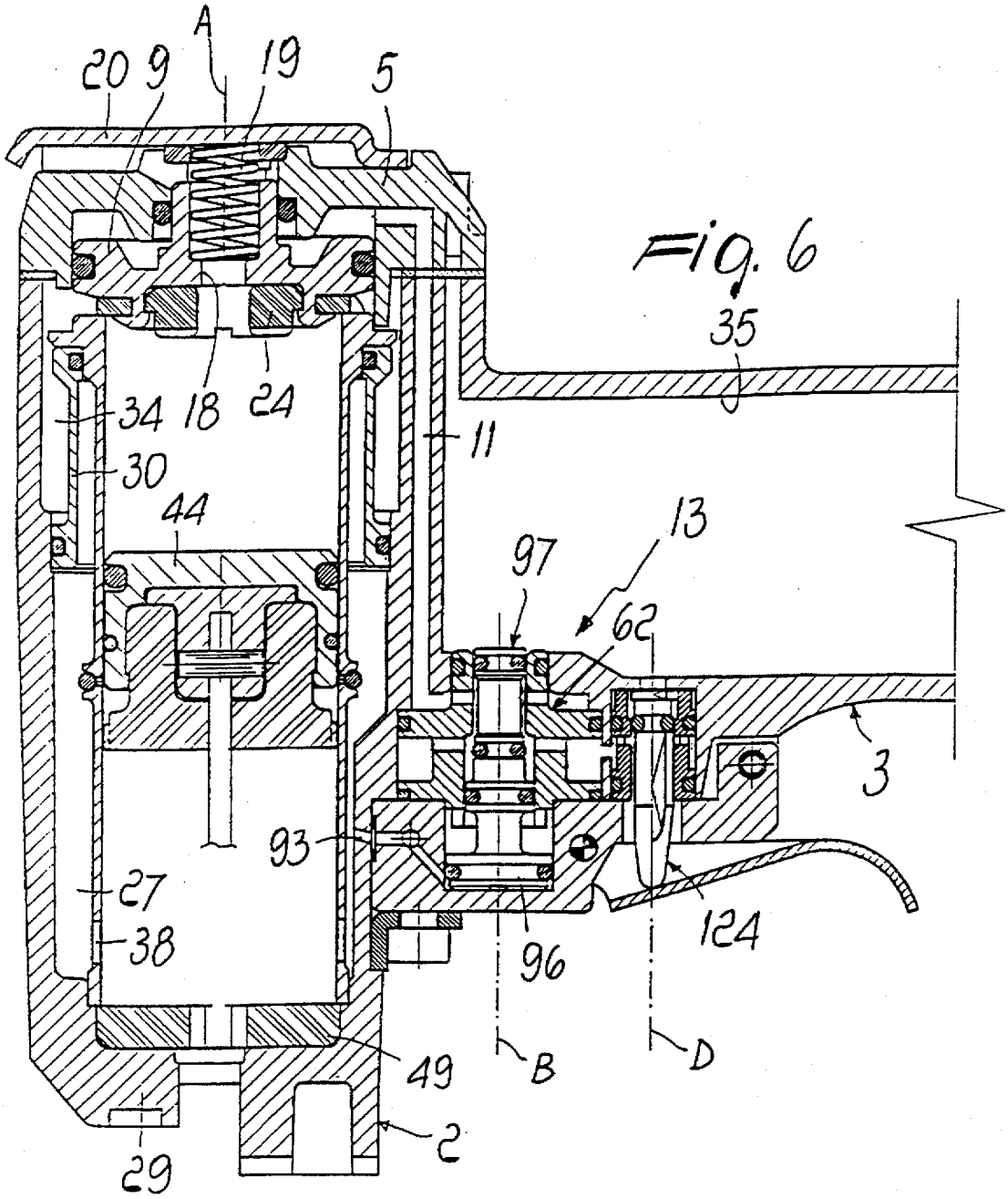

Single-firing operation of the nail firing tool (for which only FIGS. 3 and 6 are considered) is as follows.

To preset the nail firing tool for single firing, the pin 86, by acting on the lever 91, is pushed into the position for closing the hole 82. In this situation, and with the trigger 135 in the idle position (FIG. 3), the chamber 95, through the hole 113 and the chamfer 114, is at ambient pressure, so that the pressure of the compressed air, by acting on the collar 100 and on the collar 98, keeps the stem 97 constantly in a position in which the piston 96 abuts against the bottom of the recess 60 and the passage of air from the cavity 35 into the bush 106 is prevented.

This position of the stem persists also during the active stage of the nail firing tool.

The compressed air, through the passages 134, 133, 132, 129, 122, 121, 120, 115, 109, 108, 107, 110, 111, and 11, enters the chamber 10 and keeps the disk 9 rested and closed on the edge of the jacket 26, inside which the piston 44 occupies the upper stroke limit position. The counterpressure acting, through the chamber 34, on the lower face of the disk 9 is not sufficient to raise the disk 9, since the area of the lower face is smaller than the area of the upper face. If the trigger 135 (FIG. 6) is operated in this situation shown in FIG. 3, the ring 123, when it closes the compressed air, places the chamber 10 at ambient pressure through the passages 11, 111, 110, 107, 108, 109, 115, 120, 121, and 127.

The counterpressure acting from below on the disk 9 raises said disk against the action of the spring 19 until abutment of the elastic washer 21 occurs; by closing the tubular portion 14, said washer allows the compressed air to violently push the piston 44 downwards, causing the expulsion of a fixing element from the tip 47. When the piston 44 has reached the lower stroke limit, the compressed air, by acting thereon, keeps the block **44*a* hermetically rested on the shock-absorbing disk 49, so that the air that enters the interspace 27 through the perforations 39** cannot escape outside.

It should be noted that the chamber 46 is practically connected to the outside through the opening **45*a*, so that during the descent of the piston no counterpressure capable of braking the stroke of the piston can be generated in the chamber 46**.

At this point, by releasing the trigger 135, compressed air is again sent to the chamber 10, so that the disk 9, by virtue of the pressure applied thereon by the compressed air and by virtue of the action of the spring 19, returns to the position for closing the chamber 45 that lies above the piston 55, connecting said chamber 44 to the outside through the tubular portion 14 and the recess 23. The compressed air contained in the annular interspace 27 can therefore act, through the slots 38, below the piston 44, so as to push it upwards and return it to the upper stroke limit.

Figure 7:
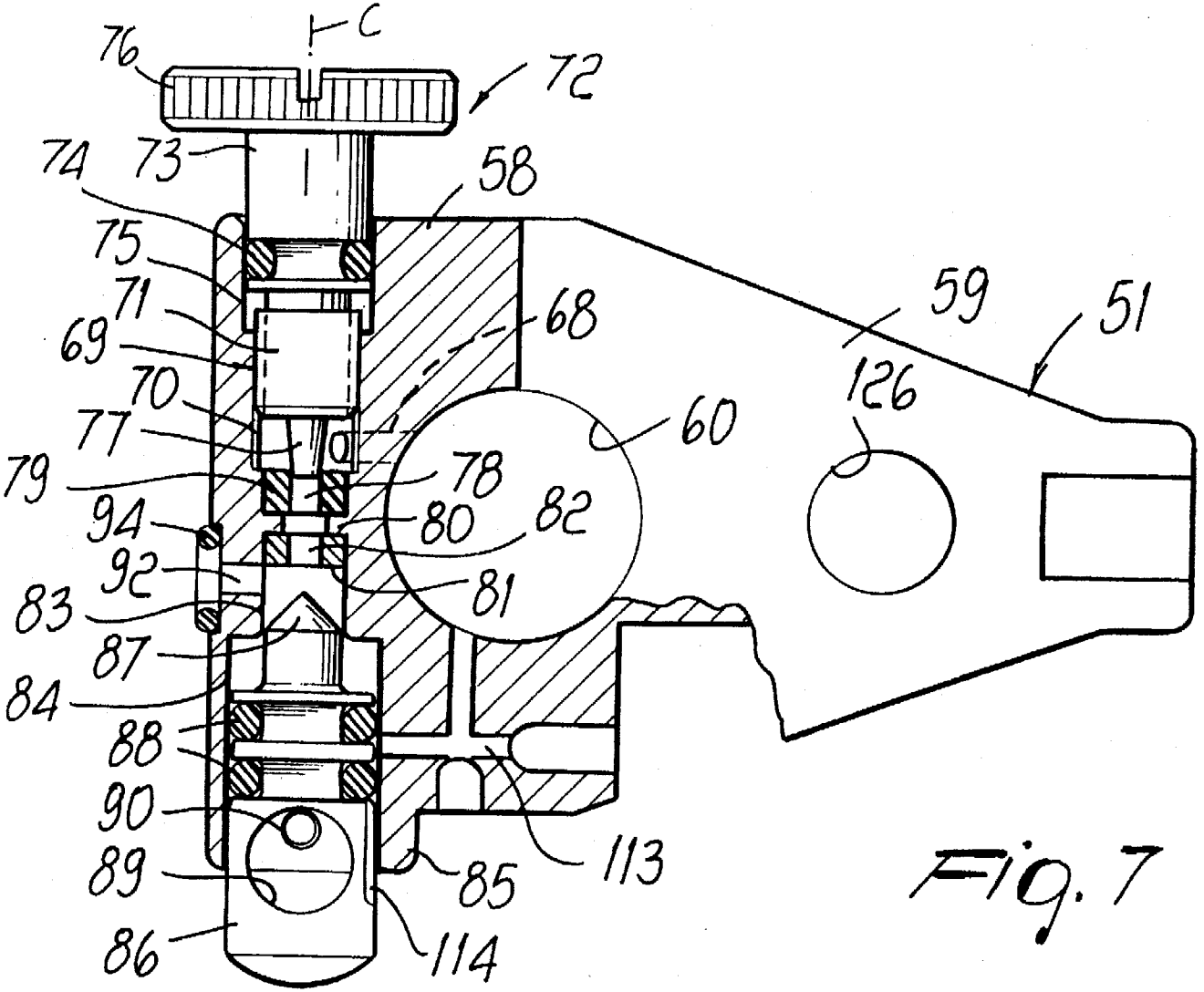
FIG. 7 is a sectional view, taken along the plane VII—VII of FIG. 3.
Figure 8:
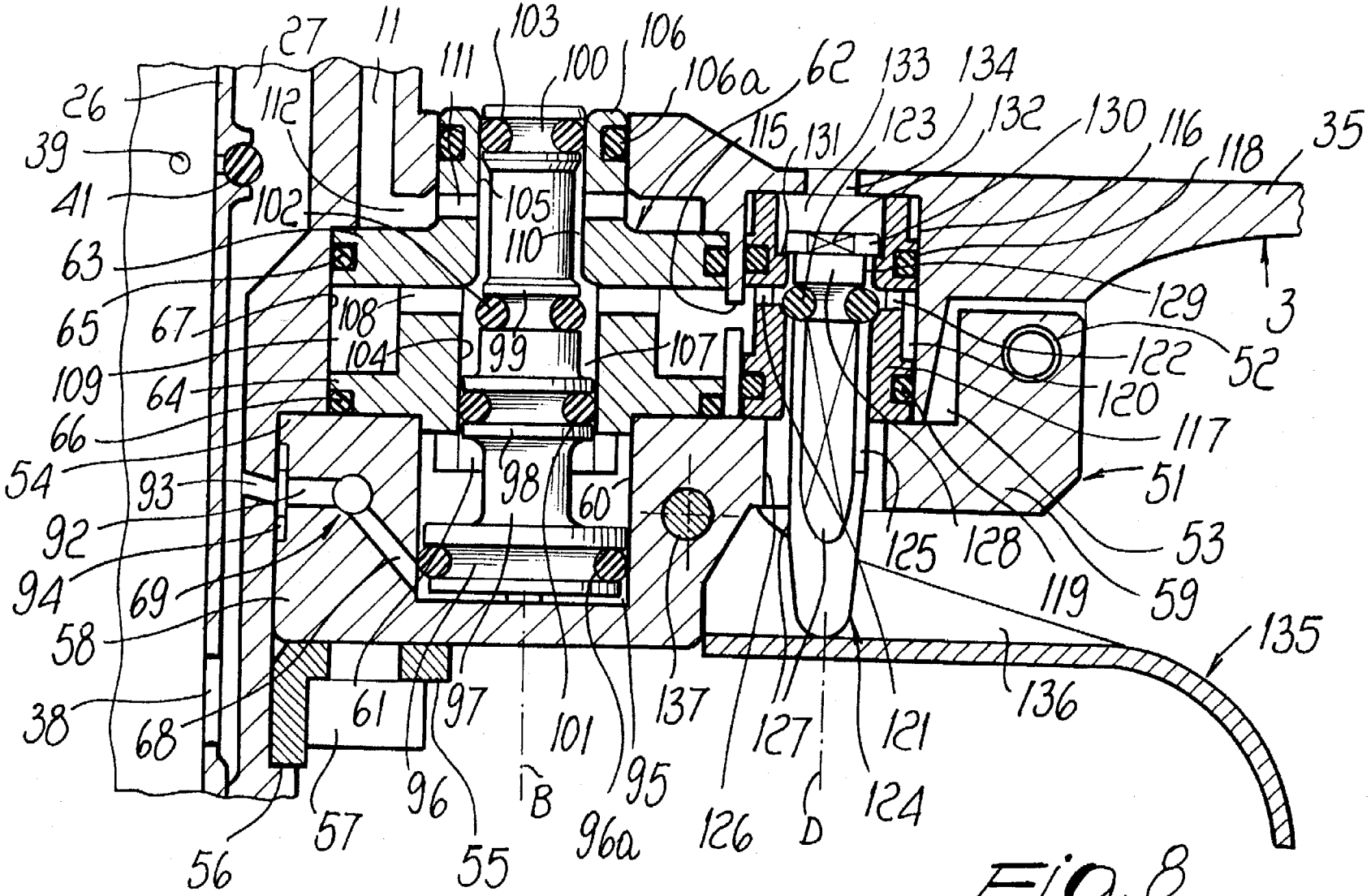
FIG. 8 is an enlarged-scale view of the region where the valve means are located.

If the nail firing tool is to perform repeat firing, the lever 91 is released, thus allowing the compressed air entering the chamber 27 to act, through the holes 91 and 92, on the pin 86, pushing it out of the seat 69 into the position for closing the duct 113 (FIG. 7). Simultaneously, the chamber 95, through the passages 68, 78, 82, 92, 93, 27, 38, and 46, is at ambient pressure, so that the stem 97 is still in a position in which the collar 100 closes the access of the compressed air to the bush 106.

The situation of FIG. 3 reoccurs, so that by acting on the trigger 135, i.e., by lifting the stem 124, the chamber 10 is connected to the discharge through the passages 11, 111, 110, 107, 108, 109, 120, 121, 127, consequently lifting the disk 9, as previously described in relation to single-firing operation.

Figure 4:
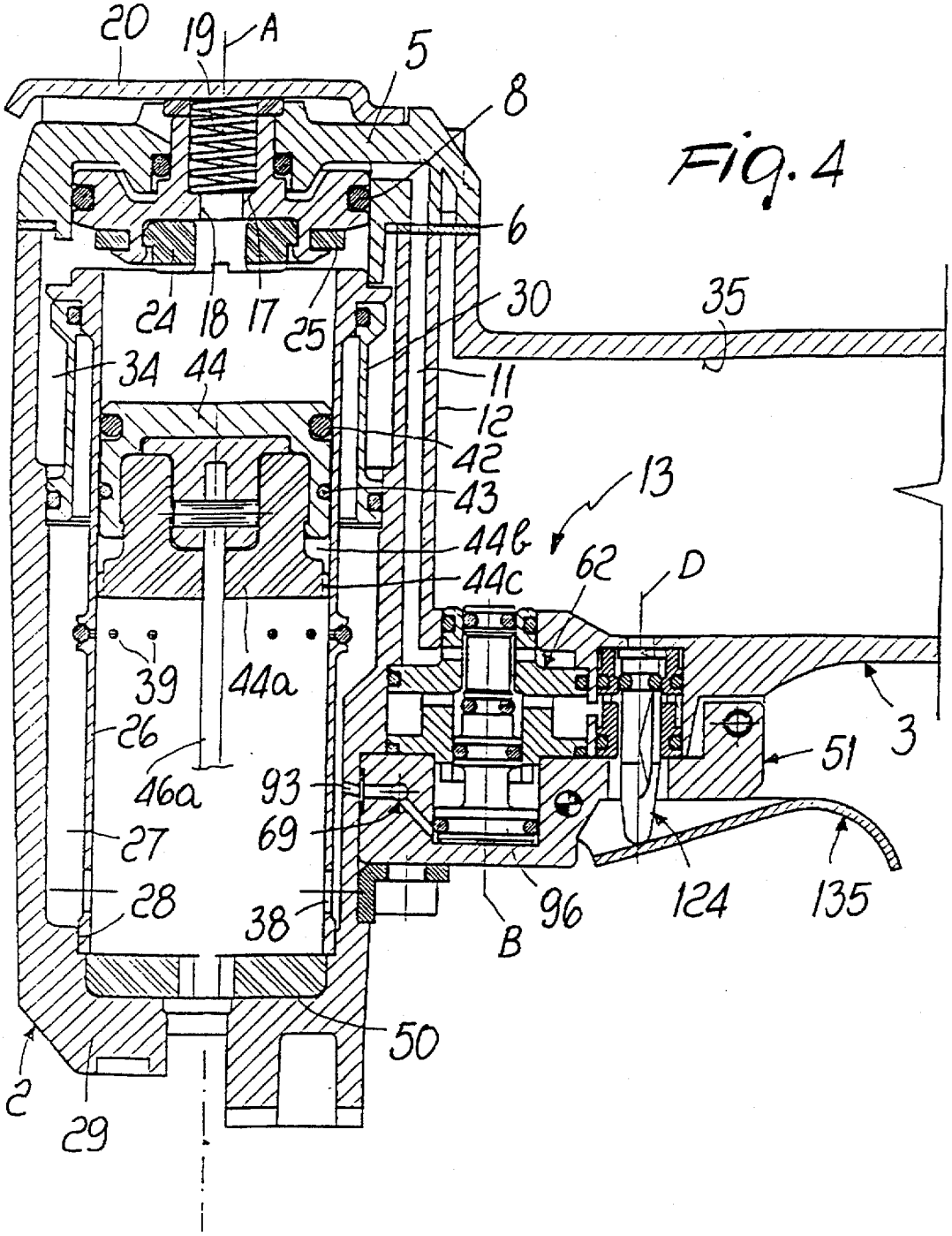
FIGS. 4, 5, and 6 are sectional views of the nail firing tool of FIG. 3 in successive operating positions.

The descent of the piston 44 and of the blade **46*a* then occurs (FIG. 4**).

However, differently from single-firing operation, when the piston 44 has descended below the holes 39, the compressed air passing in the interspace 27 can access the seat 69 through the holes 93 and 92 and then pass into the chamber 95 through the holes 82 and 78 and the duct 68. The pin 87 in fact not only no longer closes the hole 82, as in single-firing operation, but the pressure applied by the compressed air keeps it in abutment against the pin 90, in the position for closing the duct 113.

Accordingly, a pressure can form inside the chamber 95 which, by acting on the piston 96, causes the distributor 96, 97 to switch and the stem 97 to slide into a position in which the collar 99 interrupts the connection between the chambers 107 and 110 and the collar 100 opens the access to the bush 106 of the compressed air (FIG. 5) which, by means of the holes 111 and 11, can enter the chamber 10 above the disk 9. However, the pressure on the two opposite faces of the disk 9 is in equilibrium, so that the spring 19 can push the disk 9 so that it rests on the jacket 26 and closes it. As a consequence of this movement, connection to the outside is opened through the tubular portion 14 of the disk 9 and the recess 23, and this produces a decrease in the pressure inside the chamber 45 lying above the piston 44 and the closure of the perforations 39 on the part of the ring 41.

Accordingly, the piston 44, pushed by the pressure of the air contained in the interspace 27 and acting thereon through the slots 38 and the channels 44*c*, rises to the upper stroke limit and rests on the ring 24 (FIG. 6).

When the piston 44 has reached the upper stroke limit, a drop in pressure occurs in the interspace 27 and is transmitted through the holes 93, 92, 82, 78, 68 into the chamber 95, causing a difference in pressure on the stem 97 that causes the movement of the collar 100 into the position for closing the bush 106.

Accordingly, the previously described position is restored and the cycle can be repeated by keeping the trigger 135 pressed.

It is evident that the described invention perfectly achieves the intended aim and objects.

In particular, by acting on the knob 76 it is possible to adjust the opening of the hole 78 and therefore the intake of air into the chamber 95, so as to delay or quicken the movement of the piston 95 and, ultimately, the firing rate of the nail firing tool.

Particularly advantageous is the fact that the distributor 96, 97 and the shunt valve 124 can be easily accessed by removing the plate 51, so as to allow quick inspection or replacement.

What is claimed is:

1. A compressed-air nail firing tool with head valve, operating by single firing and repeat firing through a selector, said tool comprising: a body that is composed of a head, said head enclosing a cavity that is closed at one end by a cover and, at an opposite end, by a base; a tubular handle that protrudes from said head and forms a cavity, said cavity being connected to a compressed air source; a cylindrical jacket being accommodated in said cavity, said jacket forming an outer interspace; a check valve element being arranged on said jacket, said valve element allowing flow of air to pass from inside said jacket towards said interspace; a piston being guided in said jacket, said piston forming an upper chamber and a lower chamber; a striking blade, which is coupled to said piston, said blade running through said lower chamber and said base; a disk being guided in said cover coaxially to said jacket, said disk constituting said head valve, and being movable between a position for resting on said jacket, in which said upper chamber is connected to outside environment through passages of said disk and of said cover, and a position for abutment on said cover, in which said upper chamber is connected to said compressed air source, said interspace being connected to said lower chamber through slots formed in said jacket proximate to said base, said disk forming, together with said cover, a chamber that is selectively connectable to the outside and to said compressed air source; valve means for connecting said chamber to the outside and said air source; a spring acting on said disk so as to move said disk into a position for resting on said jacket; and wherein said valve means comprises: a cylindrical seat being formed in said body and being alternately selectively connectable to the outside and to said interspace through respective ducts; a shutter for controlling said ducts, which is actuatable between two positions, said shutter allowing, in one of said positions, a connection between said seat and said interspace while interrupting connection to the outside during repeat-firing operation, in a second position, the shutter interrupting connection between said seat and said interspace while allowing connection between said seat and the outside during single-firing operation; a distributor, which is composed of a piston being slideable in said seat, said piston forming a chamber into which said ducts lead; and a stem being coaxial to said piston and slideable in a sleeve, said sleeve being accommodated in said body coaxially to said seat and being connected to said seat at one end and to said cavity of said handle at an opposite end thereof, said sleeve having a first seat being connected to said chamber formed between said disk and said cover and a second seat being connectable alternately to the outside and to said cavity of the handle through a shunt valve, said shunt valve being composed of a seat formed in said body, a bush accommodated in said seat, said bush being connected, at one end thereof, to said cavity of the handle and, at an opposite end thereof, to the outside, said bush being provided with holes that are connected to said second seat of said distributor, a stem being slideable in said bush, said stem being actuated by a trigger between two positions, in a first one the stem connecting said second seat to the outside through said holes, whereas in a second one said stem connecting said second seat to said cavity of the handle.

2. Nail firing tool according to claim 1, wherein said chamber is connected to said interspace through a cylindrical seat, said seat comprising a first portion constantly connected to said chamber and a second portion connected, at one end thereof, to said interspace and, at a further end thereof, to said first portion through a hole, said hole being controlled at one end thereof by a screw screwed in said first portion, and being closeable on an opposite end thereof by said shutter, said chamber being connected to the outside when said shutter is in closure position; a lever being further provided, said lever being articulated in said body and acting on said shutter for moving it between said two positions.

3. Nail firing tool according to claim 1, wherein said sleeve has two external flanges, said flanges forming, in said body, a first outer annular chamber connected to said shunt valve and a second outer annular chamber connected to said chamber formed between said disk and said cover.

4. Nail firing tool according to claim 3, wherein said stem has two collars and a third intermediate collar, said two collars forming together with said third intermediate collar, at said seats, two annular chambers lying inside said sleeve, said chambers being connected to said first and second outer chambers through respective holes of said sleeve, said intermediate collar, when the shutter is preset for repeat-firing operation, interconnecting said two inner chambers when said stem is in a position in which a first one of said inner chambers is connected to said chamber formed between the disk and the cover and the other inner chamber is connected to the outside, and access of compressed air to said first inner chamber is prevented, whereas said inner chambers are isolated from one another when said stem is in a position in which said first inner chamber is connected to said cavity of the handle and said second inner chamber is connected to the outside.

5. Nail firing tool according to claim 4, wherein said stem has a flange movable between two abutment positions that define an actuation stroke of the stem, a ring being arranged on said stem, said ring sealingly closing an inlet for compressed air in said bush and allowing air to be discharged outside through said holes when said stem has been actuated by said trigger, and respectively closing discharge and opening an air inlet in said bush when the stem is in the inactive position.

* * * * *

UNITED STATES PATENT AND TRADEMARK OFFICE

CERTIFICATE OF CORRECTION

PATENT NO. : 5,671,880

DATED : September 30, 1997

INVENTOR(S) : RONCONI, Marco

It is certified that error appears in the above-identified patent and that said Letters Patent is hereby corrected as shown below:

On the cover page , please amend the city of the assignee in order to read:

—CADRIANO DI GRANAROLO EMILIA, ITALY--.

Signed and Sealed this

Fourteenth Day of April, 1998

*Attest:*

*Attesting Officer*

BRUCE LEHMAN

*Commissioner of Patents and Trademarks*